United States Patent [19]

Hulkenberg, Jr.

[11] Patent Number: 5,026,100

[45] Date of Patent: Jun. 25, 1991

[54] LOCK RELEASE APPARATUS

[75] Inventor: Francis J. Hulkenberg, Jr., North Richland Hills, Tex.

[73] Assignee: General Dynamics Corporation, Fort Worth, Tex.

[21] Appl. No.: 409,239

[22] Filed: Sep. 19, 1989

[51] Int. Cl.[5] ..... E05B 65/10

[52] U.S. Cl. ..... 292/92; 292/285; 292/DIG. 65; 292/DIG. 71

[58] Field of Search ..... 292/DIG. 71, 92, 21, 292/336, 254, 281, 285, DIG. 65; 70/92

[56] References Cited

U.S. PATENT DOCUMENTS

| | | | |
|---|---|---|---|
| 682,657 | 9/1901 | Wirt | 292/285 |
| 831,122 | 9/1906 | Vsetecka | 292/285 |
| 1,472,512 | 10/1923 | Carlson | 292/281 |
| 1,992,734 | 2/1935 | Bittorf | 292/285 |
| 2,625,418 | 1/1953 | Sievert | 292/92 |
| 2,746,782 | 5/1956 | Schamotta | 292/92 |
| 3,802,726 | 4/1974 | Galbreath et al. | 292/100 |
| 4,431,220 | 2/1984 | Loughlin | 292/340 |
| 4,540,207 | 9/1985 | Klasen et al. | 70/92 |
| 4,741,564 | 5/1988 | Alford | 292/285 |
| 4,765,662 | 8/1988 | Suska | 292/92 |

FOREIGN PATENT DOCUMENTS

| | | | |
|---|---|---|---|
| 215096 | 5/1958 | Australia | 292/92 |
| 402456 | 8/1909 | France . | |

*Primary Examiner*—Lloyd A. Gall
*Attorney, Agent, or Firm*—Arthur F. Zobal

[57] ABSTRACT

The apparatus includes a rod having a handle end and a cam at the other end, a housing and a hasp holding means, a housing spring, a handle and a handle spring. The housing has an aperture formed therethrough for receiving the rod. The apparatus is adapted to be assembled to wall structure for releasable securing a door. The wall structure will have an aperture formed therethrough for receiving the rod. The apparatus is assembled by locating the housing and housing spring on one side of the wall structure and the handle and handle spring on the other side of the wall structure with the rod extending through the housing aperture and through the wall aperture with its handle end coupled to the handle and handle spring and its cam located in a holding position to engage the housing such that the cam cannot pass through the housing aperture. Means is provided for preventing the housing from rotating when held next to the wall structure. The handle may be rotated to rotate the rod means to a release position where the cam can pass through the housing aperture. In this position, the housing spring moves the housing and its hasp holding means away from the wall structure for release purposes.

24 Claims, 2 Drawing Sheets

FIG. 3
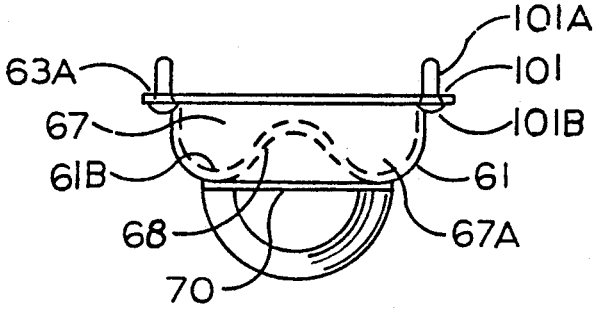
FIG. 4
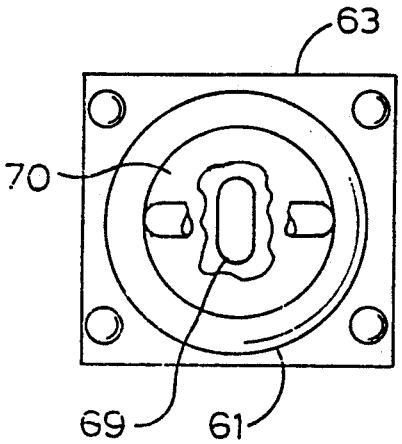
FIG. 5
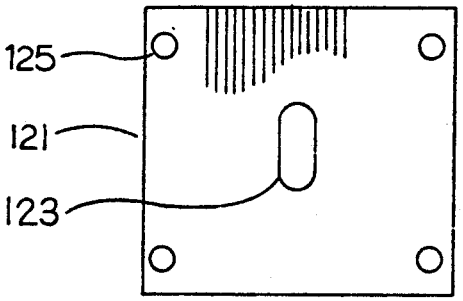
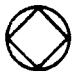
FIG. 9
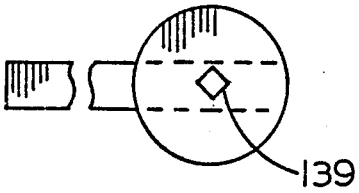
FIG. 7
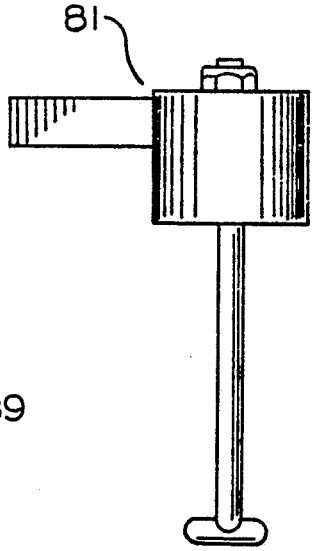
FIG. 6
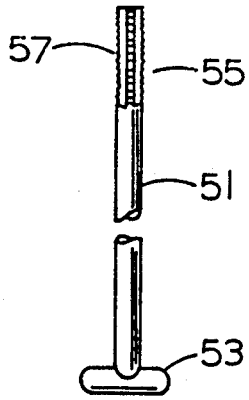
FIG 8

LOCK RELEASE APPARATUS

FIELD OF THE INVENTION

The invention relates to an apparatus for releasing a lock to allow a person to open a locked door from the inside of a facility such as a storage room, freezer, etc, in the event the person becomes accidently locked therein.

1. BACKGROUND OF THE INVENTION

In the past, people have become accidently locked in storage rooms, freezers, etc, resulting in panic and sometimes death.

2. DESCRIPTION OF THE PRIOR ART

U.S. Pat. Nos. 682,657; 831,122; 1,472,512; 1,992,734; 3,802,726; 4,431,220; 4,741,564 and French patent No. 402,456 disclose different types of fasteners and locks and safety release mechanisms. The safety release mechanisms of the devices of these patents, however, have disadvantages, for example, in their complexity, effectiveness, etc.

SUMMARY OF THE INVENTION

It is an object of the invention to provide a simple and effective apparatus to allow one to easily open a locked door in the event a person becomes accidently locked in a facility.

The apparatus comprises a rod means having a handle end and a cam at the other end, a releasable means and a hasp or fastener holding means, and a handle. The cam extends from the rod means transversely to the length thereof. The releasable means has a non-circular aperture formed therethrough for receiving the rod means. The apparatus is adapted to be assembled to wall structure for releasable securing a door. The wall structure may be a stationary wall or the door itself and will have an aperture formed therethrough for receiving the rod means. The apparatus is assembled by locating the releasable means on one side of the wall structure and the handle on the other side of the wall structure with the rod means extending through the releasable means aperture and through the wall aperture with its handle end coupled to the handle and its cam located in a holding position to engage the releasable means such that the cam cannot pass through the releasable means aperture. Means is provided for preventing the releasable means from rotating when held next to the wall structure. The handle may be rotated to rotate the rod means to a release position where the cam can pass through the releasable means aperture. In the holding position of the rod means, the apparatus is assembled in place whereby a hasp may be coupled to the hasp holding means of the releasable means on said one side of the wall structure for holding the door shut. If a person becomes accidently locked on the other side of the wall structure, the apparatus may be released from the wall structure by rotating the handle and the rod means to the release position.

In the embodiment disclosed, the rod means and its cam may be rotated in either direction from the holding position to the release position.

In another aspect, the releasable means comprises a housing with the rod receiving aperture formed therethrough and the apparatus comprises a housing spring and a handle spring. The housing spring urges the housing away from said one side of the wall structure and the handle spring urges the handle away from the other side of the wall structure and, by way of the rod means and cam, the housing next to the wall structure. In the release position of the rod means, the cam is allowed to move through the housing aperture and the housing spring moves the housing and its hasp holding means away from the wall structure for release purposes.

BRIEF DESCRIPTION OF THE DRAWINGS

FIG. 3 is a end view of the housing and hasp holding means of the apparatus of FIG. 1.

FIG. 4 is a partially broken front view of the housing and hasp holding means of FIG. 3.

FIG. 5 is a front view of a housing spring back up plate.

FIG. 6 is a side view of the handle and rod of the apparatus of the invention.

FIG. 7 is a top view of the handle of FIG. 6.

FIG. 8 is a broken side view of the rod of FIG. 6.

FIG. 9 is an enlarged handle end view of the rod of FIGS. 8 and 9.

DESCRIPTION OF THE PREFERRED EMBODIMENTS

Figure 1:
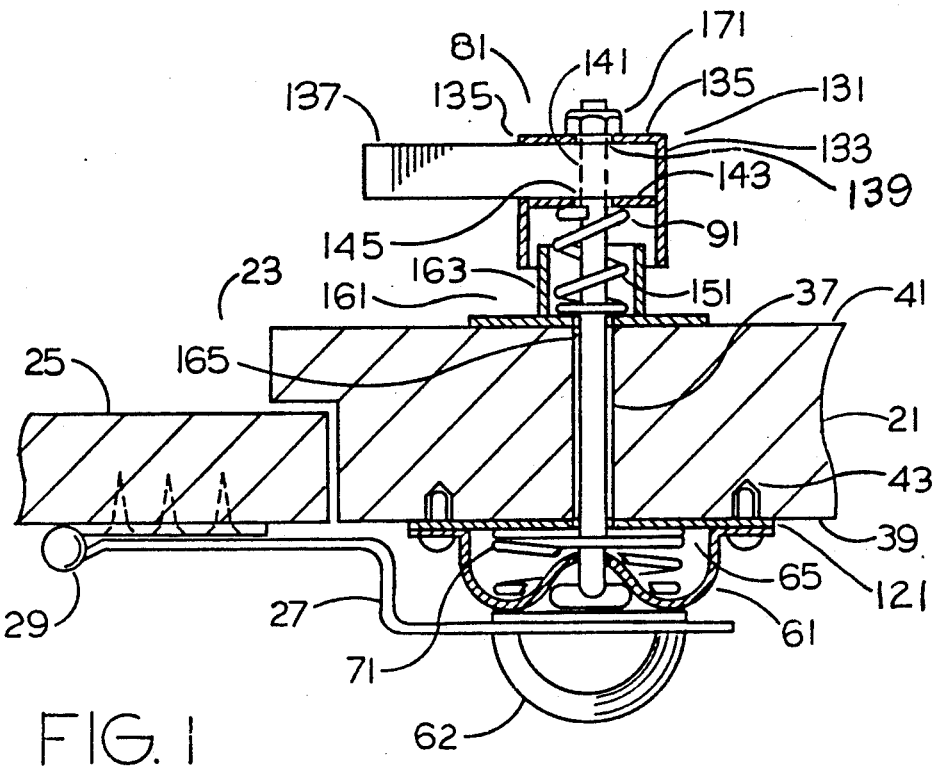
FIG. 1 is a cross sectional view of the apparatus of the invention assembled to a stationary wall for releasably holding a door.
Figure 2:
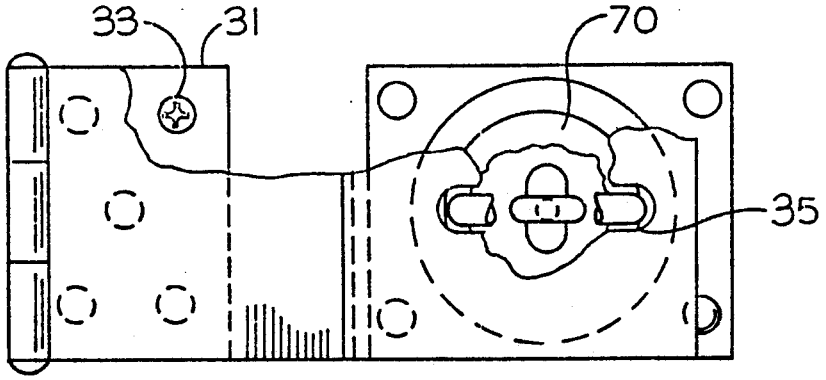
FIG. 2 is a partially broken view of the apparatus of FIG. 1.
Figure 10:
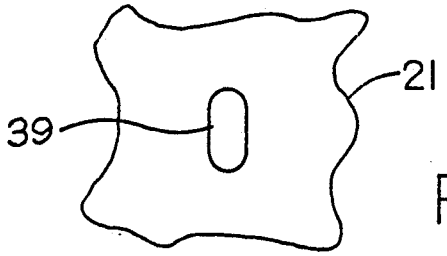
FIG. 10 illustrates the shape of the aperture formed through the wall of FIG. 1 for receiving the rod of the apparatus of the invention.

Referring to FIG. 1 of the drawings, there is disclosed a stationary wall 21 having a doorway 23, and a door 25 mounted on hinges(not shown) for opening and closing the doorway. A hasp 27 is hinged by a pin 29 to a mounting plate 31 which is secured to the door by screws 33. The hasp 27 has an opening 35 for attachment to the apparatus of the invention which is releasably secured to the wall 21. The wall 21 has an aperture 37 formed therethrough between sides 39 and 41 of the wall 21 for receiving a rod of the apparatus. The aperture 37 is generally oval shaped in cross section as seen in FIG. 10. Pin receiving apertures 43 also are formed into the side 39 of the wall 21.

Referring to FIGS. 2–10, the apparatus of the invention comprises a rod 51, a housing 61 (releasable means), having a hasp holding ring member 62 (fastener holding means) attached thereto, a housing spring 71, a handle 81, and a handle spring 91. The rod 51 is circular in cross section along most of its length and has a cam member 53 at one end defining a T-shaped end. The other end of the rod 51 is square in cross section at 55 with the corners of the square being threaded at 57.

The housing member 61 has a flanged edge 63 extending radially outward at one end surrounding an opening 65 leading to a cavity 67. The other end of the housing member 61 has a concave central portion 68 defining an annular cavity portion 67A surrounding the central portion 68. A generally oval shaped slot or aperture 69 is formed through the central portion 68 for freely receiving the rod 51 and its cam 53 when the cam 53 is aligned with the aperture 69. The cross-sectional shape of the aperture 69 is the same as that of the aperture 37. A flat plate 70 is welded to the outside of the housing 61 which covers the aperture 69 and the ring member 62 is welded to the plate 70. The plate 70 prevents someone from tampering with the cam 53 from the wall side 39. The flanged edge 63 of the housing member has four apertures 63A for freely receiving the shanks 101A of four pins 101 with their enlarged heads 101B located against the outside surface of the flanged edge 63.

A flat backing plate 121 is provided which is adapted to be located against the surface 39 of the wall 21. It has a central aperture 123 formed therethrough and which has the same shape as apertures 37 and 69 for freely receiving the rod 51 and the cam 53 when the cam 53 is aligned with the aperture 123. Four outer apertures 125 are provided for freely receiving the shanks 101A of the pins 101 The flanged edge 63 of the housing 61 may be located to engage one side of the plate 121. When the aperture 123 of the plate 121 is aligned with the aperture 69 of the housing member 61, the plate 121 and the flanged edge 63 of the housing member 61 are positioned relative to each other such that each aperture 125 of the plate 121 is aligned with one of the apertures 63A of the flanged edge 63 whereby the shanks of the four pins 101 may be inserted through the apertures 63A and 125 to extend beyond the other side of the plate 121.

Before the plate 121 and the flanged edge 63 of the housing 61 are located to engage each other, a helically coiled spring 71 is inserted into the cavity 67 such that one end of the spring 71 engages the plate 121 and the other end engages the housing wall 61B forming the annular cavity portion 67A. The spring 71 is a compression spring and can be inserted into the cavity 67 with the plate 121 engaging the flange edge 63 only by compressing the spring 71. If the compression force is released, the spring 71 will rapidly force the housing 61 away from the plate 121 from the position shown in FIG. 1.

The handle 81 comprises a cup shaped member 131 having a hollow cylindrical shaped side wall 133 joined to a flat end wall 135 with a grip member 137 extending from one side of the cup shaped member 131. The grip member 137 extends into the central opening of the cup shaped member by way of a slot or opening 138 formed through the side wall 133. The grip member 137 is connected to opposite sides of the side wall 133. A square shaped opening 139 is formed through the flat end 135 of the member 131 and a similar square shaped opening 141 is formed through the grip member 137 inside the wall 133 and aligned with the opening 139 for receiving the square cross-sectional end 55 of the rod 51 to prevent the handle 81 from rotating relative to the rod 51 and to allow the handle 81 to rotate the rod 51 by rotating the handle 81. A washer 143 is provided having a central aperture 145 for freely receiving the rod 51. The washer 143 is freely received within the cylindrical wall 133 and is adapted to engage the grip member 137 inside the wall 133.

A second helically coiled compression spring 151 is provided to be located around the rod 51 with one end engaging the washer 143 and the other end engaging a plate 161 of a spring guide having a cylindrical shaped side wall 163 coupled to the plate 161 and adapted to be freely located within the wall 133 of the handle member 131. The plate 161 has a central aperture 165 formed therethrough for freely receiving the rod 51. A nut 171 is provided for screwing to the threads 57 of the rod 51 for holding the handle 131 to the end 55 of the rod 51.

The apparatus of the invention is assembled to the wall 21 in the following manner. The spring 151 is located within the cylindrical walls 133 and 163 of the handle members such that one of the ends of the spring 151 engages the washer 143 and the other end engages the plate 161. The end 55 of the rod 51 is inserted through the aperture 165 of the plate 161; through the spring 151; and through the apertures 145, 141, and 139 of washer 143, member 137 and of wall 135 respectively. The nut 171 then is screwed to the threads 57 of the rod 51 to the desired position to obtain the desired compression of spring 151. The cam end of the rod 51 then is inserted through the aperture 37 of the wall 21 from the side 41. With the plate 121 and the housing 61 assembled together with the spring 71 located in the cavity 67 between the plate 121 and the housing 61, the cam end of the rod 51 including the cam 53 is inserted through the aperture 123 of the plate 121 and through the aperture 69 of the housing 61 and the handle 81 is rotated to rotate the cam 53 to a holding position where the cam 53 cannot pass through the aperture 69 of the housing 61. The shanks 101A of the pins 101*c* then are inserted through the apertures 63A and 125 of the housing 61 and plate 121 and into the apertures 43 of the wall 21 as shown in FIG. 1. In this position, the spring 151 urges the handle 81 away from the side 41 of the wall 21 and by way of the rod 51 and cam 53, urges the plate 121 and the edge 63 of the housing 61 against and next to the wall side 39. The spring 71 urges the housing 61 away from the wall side 39.

When it is desired to secure the closed door 25, the hasp or flap 27 is moved toward the wall side 39 such that the ring 62 is received in the hasp opening 35. A padlock can be coupled to the ring or loop 62 to lock the door.

In a person is accidentally locked on the other side of the wall 21, the person can release the apparatus and hence the door 25 by merely rotating the handle 81 90° or less in one direction or the other until the cam 53 in aligned with the housing opening 69. In this release position, cam 53 can pass through the opening 69 of the housing 61 and the spring 71 will instantly force the housing 61 away from the wall side 39 releasing the apparatus and hence the door from the locked position allowing the person to open the door and be released from the other side of the wall 21.

The purpose of the plates 121 and 161 is to provide support for the springs 71 and 151 rather than having them engage the wall 21 directly. Although the apparatus of the invention was described as being releasably attached to the stationary wall 21, it is to be understood that it could be releasably attached to the door instead and the hasp attached to the stationary wall.

I claim:

1. Apparatus for releasably securing a hasp holding means to structural means having first and second sides with an aperture formed through said structural means, said apparatus comprising:

rod means having first and second ends with cam means formed at said first end, housing means comprising structure having a first end and an open second end with said second end being adapted to be located next to said first side of said structural means, means for preventing said housing means from rotating relative to said structural means when said second end of said housing means is located next to said first side of said structural means, hasp holding means connected to said first end of said housing means for allowing a hasp to be coupled to said hasp holding means when said second end of said housing means is located next to said first side of said structural means, first spring means adapted to be located in said housing means by way of said second end of said housing means for applying pressure between said first side of said structural means and said first end of said housing means when said second end of said housing means is located next to said first side of said structural means for urging said housing means away from said first side of said structural means, a rod receiving aperture formed through said first end of said housing means for receiving said rod means for allowing said rod means to be inserted through said aperture formed through said structural means and through said aperture formed through housing means such that said first and second ends of said rod means may extend beyond said first and second sides of said structural means respectively, handle means, means for coupling said handle means to said second end of said rod means for allowing said handle means to be rotated for rotating said rod means in said aperture formed through said structural means and in said rod receiving aperture of said housing means, said rod receiving aperture being formed to prevent said cam means from passing through said rod receiving aperture when said rod means and said cam means are rotated to a holding position and for allowing said cam means to pass through said rod receiving aperture when said rod means and said cam means are rotated to a release position, second spring means adapted to be located between said second side of said structural means and said handle means and coupled to said second end of said rod means for normally urging said handle means away from said second side of said structural means and by way of said rod means and said cam means, said second end of said housing means against said first side of said structural means when said rod means and said cam means are rotated to said holding position, when said rod means and said cam means are rotated by said handle means to said release position, allowing said cam means to move through said rod receiving aperture of said housing means, said first spring means is allowed to move said housing means away from said first side of said structural means to release said housing means and its hasp holding means from said structural means.

2. The apparatus of claim 1, wherein said means for preventing said housing means from rotating comprises:

pin receiving apertures formed through said structure of said housing means, and pin means adapted to be inserted through said pin receiving apertures for insertion into apertures formed in said first side of said structural means.

3. The apparatus of claim 2, wherein:

said first end of said housing means comprises a concave central portion, said rod receiving aperture being formed through said concave central portion, and a plate secured to said first end of said housing means on the outside thereof covering said concave central portion and said rod receiving aperture from the outside.

4. The apparatus of claim 3, wherein said means for coupling said handle means to said second end of said rod means, comprises:

said second end of said rod means being non-circular in cross-section, a non-circular opening formed through said handle means for receiving said second end of said rod means for preventing said handle means from rotating relative to said rod means, said second end of said rod means having an end portion which is insertable beyond said handle means and having threads formed thereon, and a nut for screwing onto said threads of said end portion of said rod means for securing said handle means to said rod means.

5. The apparatus of claim 2, wherein said means for coupling said handle means to said second end of said rod means, comprises:

said second end of said rod means being non-circular in cross-section, a non-circular opening formed through said handle means for receiving said second end of said rod means for preventing said handle means from rotating relative to said rod means, said second end of said rod means having an end portion which insertable beyond said handle means and having threads formed thereon, and a nut for screwing onto said threads of said end portion of said rod means for securing said handle means to said rod means.

6. The apparatus of claim 1, wherein:

said first end of said housing means comprises a concave central portion, said rod receiving aperture being formed through said concave central portion, and a plate secured to said first end of said housing means on the outside thereof covering said concave central portion and said rod receiving aperture from the outside.

7. The apparatus of claim 6, wherein said means for coupling said handle means to said second end of said rod means, comprises:

said second end of said rod means being non-circular in cross-section, a non-circular opening formed through said handle means for receiving said second end of said rod means for preventing said handle means from rotating relative to said rod means, said second end of said rod means having an end portion which is insertable beyond said handle means and having threads formed thereon, and a nut for screwing onto said threads of said end portion of said rod means for securing said handle means to said rod means.

8. The apparatus of claim 1, wherein said means for coupling said handle means to said second end of said rod means, comprises:

said second end of said rod means being non-circular in cross-section, a non-circular opening formed through said handle means for receiving said second end of said rod means for preventing said handle means from rotating relative to said rod means, said second end of said rod means having an end portion which is insertable beyond said handle means and having threads formed thereon, and a nut for screwing onto said threads of said end portion of said rod means for securing said handle means to said rod means.

9. The apparatus of claim 1, wherein:

said cam means extends transversely from the length of said rod means, said rod receiving aperture is non-circular in shape.

10. The apparatus of claim 9, wherein:

said rod means and said cam means may be rotated less than 180° in either direction from said holding position to said release position.

11. The apparatus of claim 10, wherein:

said housing means comprises a cavity portion with edge means extending radially outward therefrom, said means for preventing said housing means from rotating comprises:

pin receiving apertures formed through said edge means, and pin means adapted to be inserted through said pin receiving apertures for insertion into apertures formed in said first side of said structural means.

12. Apparatus for releasably securing a hasp holding means to first structural means having first and second sides with an aperture formed through said first structural means, said apparatus comprising:

rod means having first and second ends with cam means formed at said first end, said cam means extending from said rod means transversely to the length thereof, releasable means adapted to be located next to said first side of said first structural means, means adapted to be releasably coupled to said first structural means for preventing said releasable means from rotating relative to said first structural means when said releasable means is located next to said first side of said first structural means, fastener holding means connected to said releasable means for allowing a fastener to be coupled to said fastener holding means when said releasable means is located next to said first side of said first structural means, said fastener being adapted to be coupled to second structural means with one of said structural means being movable relative to the other of said structural means, a non-circular rod receiving aperture formed through said releasable means for receiving said rod means for allowing said rod means to be inserted through said aperture formed through said first structural means and through said aperture formed through said releasable means such that said first and second ends of said rod means may extend beyond said first and second sides of said first structural means respectively, handle means, means for coupling said handle means to said second end of said rod means for allowing said handle means to be rotated for rotating said rod means in said aperture formed through said first structural means and in said rod receiving aperture of said releasable means, said rod receiving aperture being shaped to prevent said cam means from passing through said rod receiving aperture when said rod means and said cam means are rotated to a holding position and to allow said cam means to pass through said rod receiving aperture when said rod means and said cam means are rotated to a release position to release said releasable means and its fastener holding means from said first structural means.

13. The apparatus of claim 12, comprising:

means for forcing said releasable means from said structural means when said rod means and said cam means are rotated to said release position.

14. The apparatus of claim 13, wherein:

said rod means and said cam means may be rotated in either direction from said holding position to said release position.

15. The apparatus of claim 12, wherein:

said rod means and said cam means may be rotated in either direction from said holding position to said release position.

16. The apparatus of claim 1, comprising:

means adapted to be located between said second side of said structural means and said handle means for normally urging said handle means away from said second side of said structural means and by way of said rod means and said cam means, said releasable means against said first side of said structural means when said rod means and said cam means are located in said holding position.

17. The apparatus of claim 16, wherein:

said rod means and said cam means may be rotated in either direction from said holding position to said release position.

18. The apparatus of claim 16, comprising:

means for forcing said releasable means from said structural means when said rod means and said cam means are rotated to said release position.

19. The apparatus of claim 18, wherein:

said rod means and said cam means may be rotated in either direction from said holding position to said release position.

20. Apparatus for releasably securing a fastener to first structural means having first and second sides with an opening through said first structural means, said apparatus comprising:

rod means having first and second ends with cam means formed at said first end, said cam means extending from said rod means transversely to the length thereof, releasable means adapted to be located next to said first side of said first structural means and releasable therefrom by operation of said apparatus, means adapted to be releasably coupled to said first structural means for preventing said releasable means from rotating relative to said first structural means when said releasable means is located next to said first side of said structural means, fastener holding means connected to said releasable means for allowing a fastener to be coupled to said fastener holding means, said fastener being adapted to be coupled to second structural means with one of said structural means being movable relative to the other of said structural means, an aperture formed through said releasable means for receiving said rod means for allowing said rod means to be inserted through said opening formed through said first structural means such that said first and second ends of said rod means may extend beyond said first and second sides of said first structural means respectively, said rod means being rotatable in either direction in said opening and in said aperture, said aperture being shaped to prevent said cam means from passing therethrough when said rod means and said cam means are rotated to a holding position and to allow said cam means to pass through said aperture by solely axial movement of said rod means when said rod means and said cam means are rotated to a release position to release said releasable means and its fastener holding means from said first structural means.

21. A fastener device for locking a door or other movable closure over an opening in a structure and capable of quick release from within the structure comprising:

fastener means having first and second portions lockingly engageable with each other with one of said portions attachable to a movable closure to the structure and another portion to a fixed or wall portion thereof;

one of said portions being a flap containing a slot, the other of said portions having a loop for protruding through the slot when said first and second portions are lockably engaged;

one of said fastener portions having a) releasable means adapted to be positioned exteriorly of said structure and b) operating means adapted to be positioned interiorly of said structure for effecting engagement and disengagement of said releasable means from said structure;

said releasable means and operating means releasably held by connector rod means extending through said structure;

said rod means having an enlargement thereon at one end and engageable with said releasable means and a securement means at the other end engaging said operating means so as to draw said releasable means toward said operating means, thus clamping the releasable means against said structure;

said releasable means having an engagement surface for abutment thereon of said enlargement and having an escapement port for release therethrough of said enlargement; and biasing means tending to force said releasable means and said operating means apart;

whereby engagement of said enlargement against said releasable means is effective to hold said releasable means against said structure and rotational movement of said rod means by said operating means permits axial movement of said rod means and said enlargement relative to said releasable means so as to allow said enlargement to move through said escapement port of the releasable means and permitting the biasing means to free said releasable means from engagement to said structure thereby releasing the door from its locked condition and permitting the door to be opened from within.

22. The fastener device of claim 21 in which said biasing means comprises spring means including a first spring section positioned exteriorly of said structure and a second spring section positioned interiorly of said structure.

23. The fastener device of claim 22 in which one of said spring sections is adapted to urge said connector rod means axially away from said releasable means; and said other of said spring sections is adapted to urge said releasable means away from contact with said structure whereby said loop engaged through the slot of said flap can be drawn with said flap away from said other portion of said fastener device.

24. The fastener device of claim 21 in which a quarter turn of said operating means is effective to release said releasable means by solely axial movement of said connector rod means with respect to said releasable means.

* * * * *